US010293977B2

(12) United States Patent
Assil

(10) Patent No.: US 10,293,977 B2
(45) Date of Patent: May 21, 2019

(54) VODKA BOTTLE: PASS THROUGH LOGO INSERT

(71) Applicant: EVI Spirits LLC, Beverly Hills, CA (US)

(72) Inventor: Allen J. Assil, Beverly Hills, CA (US)

(73) Assignee: EVI Spirits, Beverly Hills, CA (US)

( * ) Notice: Subject to any disclaimer, the term of this patent is extended or adjusted under 35 U.S.C. 154(b) by 0 days.

(21) Appl. No.: 15/158,805

(22) Filed: May 19, 2016

(65) Prior Publication Data

US 2016/0340083 A1 Nov. 24, 2016

Related U.S. Application Data

(60) Provisional application No. 62/165,661, filed on May 22, 2015.

(51) Int. Cl.

| | |
|---|---|
| ***B65D 23/12*** | (2006.01) |
| ***B65D 23/14*** | (2006.01) |
| ***B65D 1/02*** | (2006.01) |
| *B65D 41/04* | (2006.01) |

(52) U.S. Cl.

CPC ..... *B65D 23/14* (2013.01); *B65D 1/0223* (2013.01); *B65D 23/12* (2013.01); *B65D 41/04* (2013.01)

(58) Field of Classification Search

CPC ..... B65D 1/0223; B65D 23/12; B65D 23/14; B65D 21/0237; B65D 25/20; B65D 25/205; A61J 11/0035; A47G 19/2227; A47G 19/2272; A47G 19/025; A45C 11/20; A45F 3/01; Y10T 403/55

USPC ..... 206/459.5, 457, 541, 547; 215/383, 385, 215/390; 40/310

See application file for complete search history.

(56) References Cited

U.S. PATENT DOCUMENTS

| | | | | | |
|---|---|---|---|---|---|
| 698,135 | A | * | 4/1902 | Prokop | G09F 3/04 206/831 |
| 728,735 | A | * | 5/1903 | Lowenstein | B65D 23/12 215/390 |
| D47,650 | S | * | 7/1915 | Roach | D9/535 |
| 1,554,191 | A | * | 9/1925 | Alexander | B65D 23/14 116/334 |
| 2,722,086 | A | * | 11/1955 | Mullen | C03B 23/26 215/385 |
| 3,171,559 | A | * | 3/1965 | Ferree | B65D 23/14 215/385 |
| 3,225,951 | A | * | 12/1965 | Poston | B60S 1/50 215/10 |

(Continued)

FOREIGN PATENT DOCUMENTS

WO 2014/090824 A1 6/2014

*Primary Examiner* — Gideon R Weinerth

(57) ABSTRACT

A container having a fluid reservoir and a channel for receiving an insert. The channel allows the insert to be secured to the container for displaying a portion of the insert, such as a faceplate of the insert and/or a back end of the insert. The insert may also be visible through a transparent portion of the container. The insert may include a marking or advertising logo. For example, the insert may include a 3-dimensional logo that extends through at least a portion of the container. In an embodiment, the insert is made from a different material than the container. For example, the container may include a transparent glass material and the insert may include an aluminum material that is visible through the transparent glass material of the container.

19 Claims, 6 Drawing Sheets

(56) References Cited

U.S. PATENT DOCUMENTS 3,443,710 A * 5/1969 Hills ..... B65D 1/0223 215/385
3,750,890 A * 8/1973 Smith ..... A47G 29/08 211/59.1
4,235,343 A * 11/1980 Thompson ..... B65D 21/0237 215/10
4,570,808 A 2/1986 Campbell et al.
4,765,514 A * 8/1988 Berglund ..... B65D 1/04 215/385
D310,958 S * 10/1990 Biesecker ..... D9/549
5,050,757 A * 9/1991 Hidding ..... B65D 21/0237 215/383
5,135,116 A * 8/1992 Panzetti ..... B65D 21/0237 206/504
5,156,283 A * 10/1992 Sampson ..... A47G 19/2227 206/457
5,201,431 A * 4/1993 Berger ..... B65D 23/12 215/383
5,351,851 A * 10/1994 Powell ..... B65D 23/12 215/6
6,588,593 B2 * 7/2003 Woskoski ..... A47G 19/2227 206/217
D519,033 S * 4/2006 Romano ..... D9/535
7,178,533 B2 * 2/2007 Andrion ..... B65D 23/12 132/308
D547,663 S * 7/2007 Reyes ..... D9/535
7,357,265 B2 * 4/2008 Zoller ..... B65D 23/14 206/457
D570,698 S * 6/2008 Wagner ..... D9/535
8,002,129 B1 * 8/2011 Reyes ..... B65D 1/04 215/387
9,061,797 B2 * 6/2015 Goldburt ..... B65D 23/14
9,776,765 B2 * 10/2017 Stephens ..... B65D 23/12
D802,443 S * 11/2017 Ahlm ..... D9/744
9,932,147 B1 * 4/2018 Ahlm ..... B65D 21/0237
2004/0004829 A1 * 1/2004 Policappelli ..... A47G 19/025 362/101
2004/0226904 A1 * 11/2004 Schroeder ..... B65B 61/202 215/6
2005/0067414 A1 * 3/2005 Lipson ..... B29C 49/54 220/23.86
2005/0081879 A1 * 4/2005 Andrion ..... B65D 23/12 132/308
2006/0042969 A1 * 3/2006 Swan ..... B65D 23/14 206/232
2006/0049066 A1 * 3/2006 Wang ..... A45F 3/16 206/217
2006/0091097 A1 * 5/2006 Cooper ..... B65D 23/14 215/6
2006/0131188 A1 * 6/2006 Lindemann ..... B65D 1/0284 206/217
2007/0026112 A1 * 2/2007 Zimmerman ..... A23L 2/52 426/106
2010/0006534 A1 * 1/2010 Dlouhy ..... B65D 23/12 215/383
2010/0300913 A1 * 12/2010 Goldburt ..... B65D 23/12 206/459.1
2011/0100852 A1 * 5/2011 Goldburt ..... B65D 23/14 206/459.5
2011/0286782 A1 * 11/2011 Castellani ..... A45D 34/04 401/125
2012/0187008 A1 * 7/2012 Gillingwater ..... B29C 49/54 206/232
2013/0327766 A1 * 12/2013 Skelton ..... A45C 11/20 220/23.89
2014/0262897 A1 * 9/2014 Smith ..... B65D 23/14 206/459.1
2015/0047999 A1 * 2/2015 Spain ..... A47G 19/2227 206/459.5
2016/0214764 A1 * 7/2016 Cukman ..... B65D 23/14
2017/0000275 A1 * 1/2017 Brown ..... G09F 23/04
2018/0360243 A1 * 12/2018 O'Neal ..... A47G 19/2227

* cited by examiner

VODKA BOTTLE: PASS THROUGH LOGO INSERT

RELATED APPLICATIONS

This application claims benefit to U.S. Provisional Application No. 61/165,661 filed May 22, 2015, which is hereby incorporated herein by reference.

TECHNICAL FIELD

The present disclosure relates generally to fluid containers, and more particularly to vodka bottles with a pass through logo insert.

BACKGROUND

A container is a tool that typically creates a partially or full-enclosed space that can be used to contain, store, and transport objects or materials. Objects and materials kept inside the container are typically protected by outer walls that partially or fully-surround the objects and materials.

Some containers include markings or logos, for example to advertise a particular idea or brand. Traditionally, such markings and logos come in the form of a sticker that is pasted onto the containers. Some other markings and logos are custom made for each container, for example by molding or engraving the container to have a marking or a logo displayed for users to see.

SUMMARY

The present disclosure provides a container having a fluid reservoir and a channel for receiving an insert. The channel allows the insert to be secured to the container for displaying a portion of the insert, such as a faceplate of the insert and/or a back end of the insert. The insert may also be visible through a transparent portion of the container. The insert may include a marking or advertising logo. For example, the insert may include a 3-dimensional logo that extends through at least a portion of the container. In an embodiment, the insert is made from a different material than the container. For example, the container may include a transparent glass material and the insert may include an aluminum material that is visible through the transparent glass material of the container.

According to one aspect of the invention, a container including a fluid reservoir, an opening fluidly connected to the fluid reservoir for allowing fluid to enter and/or exit the reservoir, an inner wall forming at least a portion of an inner channel configured to receive an insert, wherein the fluid reservoir includes a first reservoir portion adjacent the opening, and wherein the fluid reservoir includes a fluid channel fluidly connecting the first reservoir to a second reservoir portion, the second reservoir portion being opposite the first reservoir portion relative to the inner wall.

The container may further include an axial facing ledge at an end of the channel to prevent axial movement of the insert in a first axial direction relative to the container.

The container may further include a radially inward facing faceplate wall at an end of the channel to prevent axial movement of the insert relative to the container.

The container may further include a radially inward facing faceplate wall configured to press-fit against a radially outwardly facing surface of the insert.

The channel may be a through passage configured to receive an insertable wall of the insert.

The inner wall may be configured to circumscribe an insertable wall of the insert.

The container may further include a cap to close the opening.

The channel may be fluidly separated from the fluid reservoir.

According to another aspect of the invention, a container assembly including a container including a fluid reservoir, and an opening fluidly connected to the fluid reservoir configured for at least one of enclosing or retaining of fluid, and an insert in a channel of the container, wherein the channel is formed by one or more inner walls, and wherein the channel is spaced from the opening, wherein the insert is configured to be secure in the channel of the container, wherein the channel extends along a longitudinal axis of the container, and the channel is fluidly separated from the fluid reservoir by the one or more inner walls.

The insert may include an insertable wall having a plurality of planar radially outwardly facing surfaces for engaging a plurality of planar radially inwardly facing surfaces of the container assembly.

The insert may be fluidly separated from the fluid reservoir.

Inner walls may define the channel and fluidly separate the channel from the fluid reservoir.

The insert may include an insertable wall that engages the inner walls.

The insert may include a faceplate that engages an axially facing ledge to prevent axial movement of the faceplate in a first direction relative to the axially facing ledge.

The insert may include a faceplate that engages a radially inward facing faceplate wall to prevent axial movement of the faceplate relative to the radially inward facing faceplate wall.

The insert may have a cross section in the shape of a logo.

The insert may be at least partially made of aluminum.

The container may be at least partially made of glass.

The container assembly may further include a cap to close the opening.

The foregoing and other features of the invention are hereinafter described in greater detail with reference to the accompanying drawings.

DETAILED DESCRIPTION

The principles of this present application have particular application to displaying advertisements on fluid containers for alcohol and thus will be described below chiefly in this context. It will be appreciated that principles of this disclosure may be applicable to containers for other materials.

Figure 1:
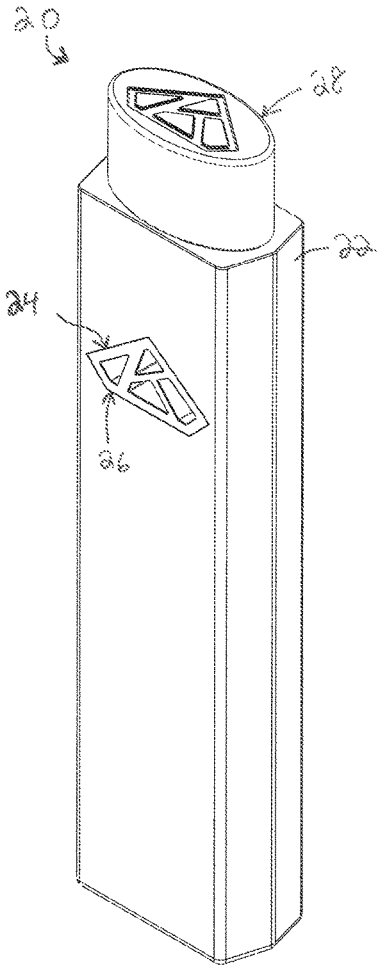
FIG. 1 is a perspective view of an exemplary container assembly.
Figure 2:
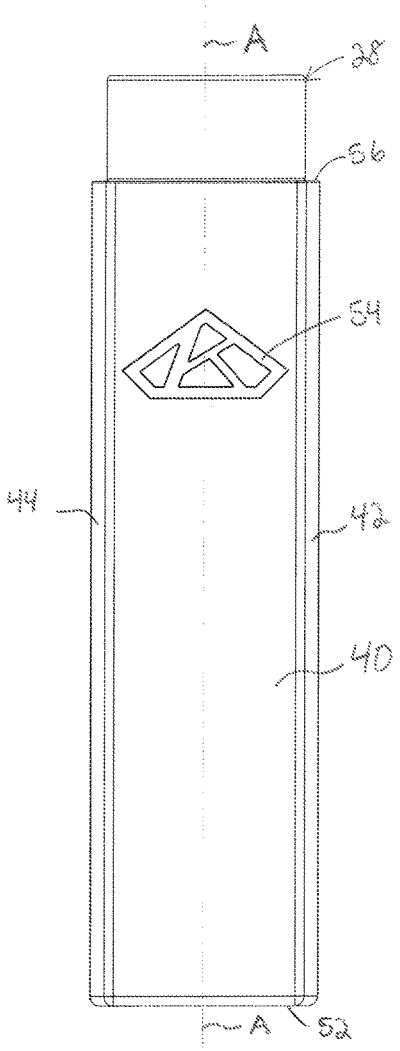
FIG. 2 is a front view of the container assembly of FIG. 1.

Referring now to the drawings and initially to FIG. 1, a container assembly is designated generally by reference numeral 20. The container assembly 20 may include a container 22, an insert 24 for insertion into a channel 26 of the container 22, and a cap 28 for closing the container 22.

Referring now to FIGS. 2-5, the container may include outer walls 40-50 that circumscribe a central axis A. Each outer wall may form a respective outer surface, for example, the outer wall 40 may form a front outer surface that faces radially outward from the central axis A.

A base 52 may extend radially outward from the central axis A to connect to a respective base end of each outer wall 40-50. For example, the base 52 may include a planar wall that extends parallel to a plane that is perpendicular to the central axis A. The planar wall may allow the container 22 to remain upright on a flat surface—such as a flat surface of a table (not shown)—upon the base 52 being set on the flat surface. In an embodiment, the base is any other suitable shape for forming a base. In another embodiment, the base may extend along a plane that is not perpendicular to the central axis.

After the container assembly 22 is assembled (i.e., the insert 24 is inserted into the channel 26) a front insert surface 54 (shown in FIG. 2) of the insert 24 may be flush with the front outer surface of the outer wall 40. For example the front insert surface 54 may be coplanar with the front outer surface of the outer wall 40. In an embodiment, the front insert surface and the front outer surface are not coplanar. For example, a portion of the front insert surface or the entire front insert surface may be recessed the front outer surface. Alternatively, a portion of the front insert surface or the entire front insert surface may protrude from the front outer surface.

A top wall 56 may extend radially outward from the central axis A to connect to a respective top end—opposite the base end relative to the outer walls 40-50—of each outer wall 40-50. For example, the top wall 56 may include a planar wall that extends parallel to a plane that is perpendicular to the central axis A.

In an embodiment, the top wall 56 is not parallel to the base 52. For example, the base 52 may not be planar and/or the top wall 56 may not be planar.

Figure 6:
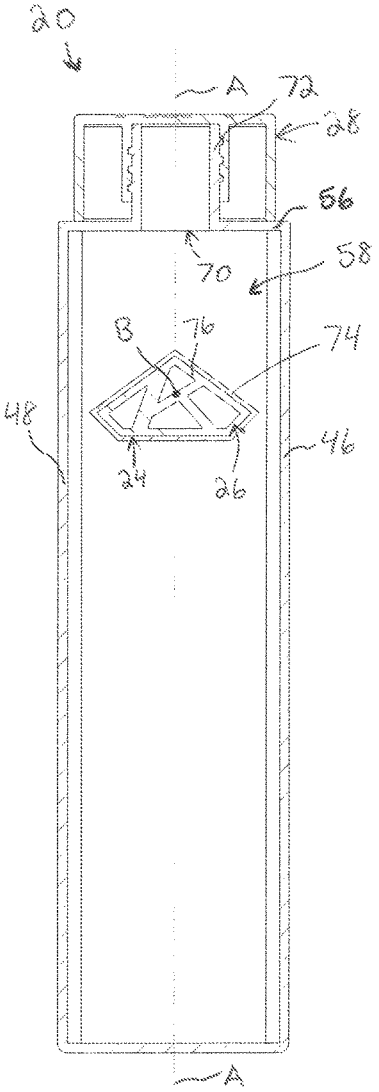
FIG. 6 is a cross-section view of the of the container assembly of FIG. 5.
Figure 7:
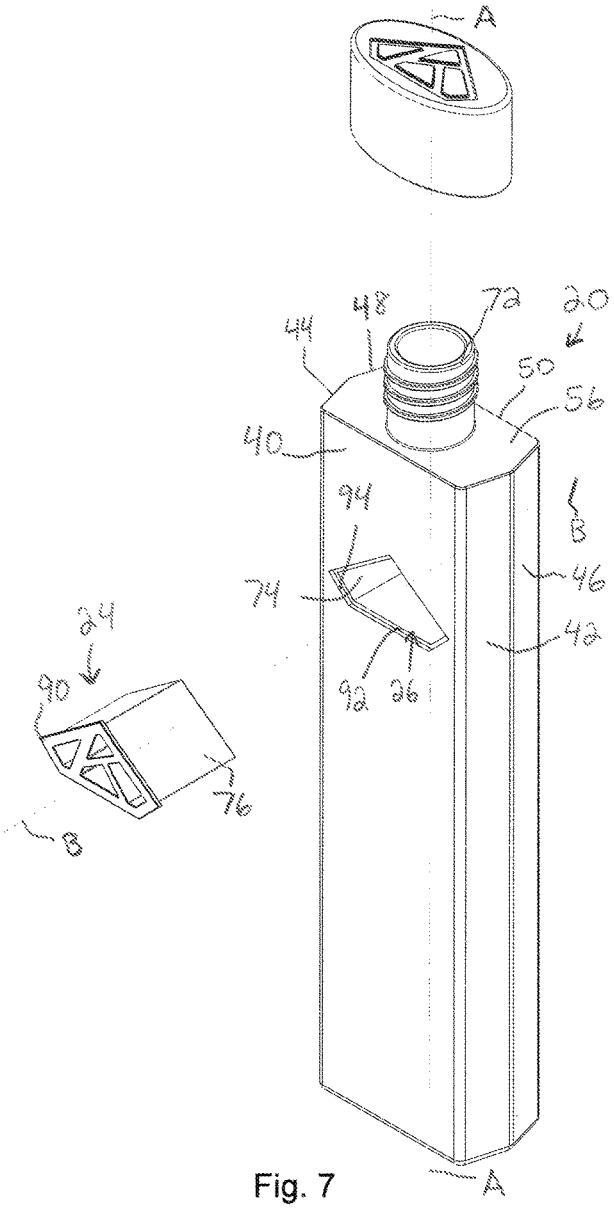
FIG. 7 is an exploded perspective view of the of the container assembly of FIG. 1.

Referring now to FIGS. 6 and 7, a fluid reservoir 58 may be formed by the outer walls 40-50, the base 52, and the top wall 56. An opening 70 in the top wall 56 may be fluidly connected to the fluid reservoir 58. The opening 70 may allow fluid to flow to and/or to flow from the reservoir 58. For example, a potable liquid, such as alcohol, may be poured into the reservoir 58 via the opening 70. At a later point in time, the potable liquid may be poured out of the reservoir 58 via the opening 70. In an embodiment, more than one opening may be fluidly connected to the reservoir.

A neck 72 may circumscribe the opening 70. The neck 72 may extend axially along the central axis A from the top wall 56 to provide a fluid conduit to and/or from the opening 70. The neck 72 may be annular and may include threads to engage threads of the cap 28. The threads of the neck 72 may extend radially outwardly relative to the central axis A to engage radially inwardly extending threads of the cap 28.

An inner wall 74 may circumscribe a longitudinal axis B and extend from the outer wall 40 to the outer wall 50. The inner wall 74 may form radially inward facing surfaces—relative to the longitudinal axis B—that form the channel 26. The channel 26 may be configured to receive the insert 24. For example, the channel 26 may have a pentagonal cross-section perpendicular to the longitudinal axis B.

The inner wall 74 may be disposed intermediate of the top wall 56 and the base 52. For example, the inner wall 74 may be disposed axially offset—relative to the central axis A—of the top wall 74 and the base 32. The inner wall 74 may extend closer to the top wall 56 than the base 52. In an embodiment, the inner wall is disposed in any suitable position relative to the base and the top wall. For example, the base or the top wall may form a portion of the inner wall.

The longitudinal axis B may be perpendicular to the outer wall 40 and the central axis A. In an embodiment, the longitudinal axis B is not perpendicular to the central axis A. In another embodiment, the longitudinal axis B is not perpendicular to the front surface of the outer wall.

The insert 24 may include an insertable wall 76 that has a cross-section that matches the cross-section of the channel 26 to allow the insertable wall 76 to slide into the channel 26 along the longitudinal axis B. For example, the insertable wall 76 may have a pentagonal cross-section. The size of the cross-section of the insertable wall 76 may be slightly smaller than the cross-section of the channel 26 to allow the insertable wall 76 to easily slide within the channel 26. In an embodiment, the size of the cross-section of the insertable wall is equal to or slightly smaller than the cross-section of the channel to allow the insertable wall to press-fit against the radially inwardly facing surfaces that form the channel.

Figure 3:
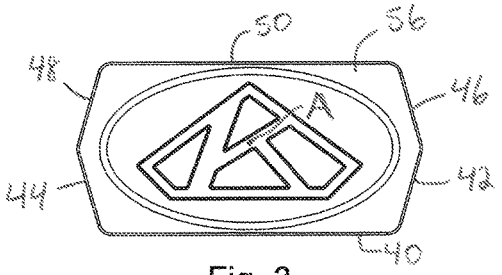
FIG. 3 is a top view of the container assembly of FIG. 1.
Figure 4:
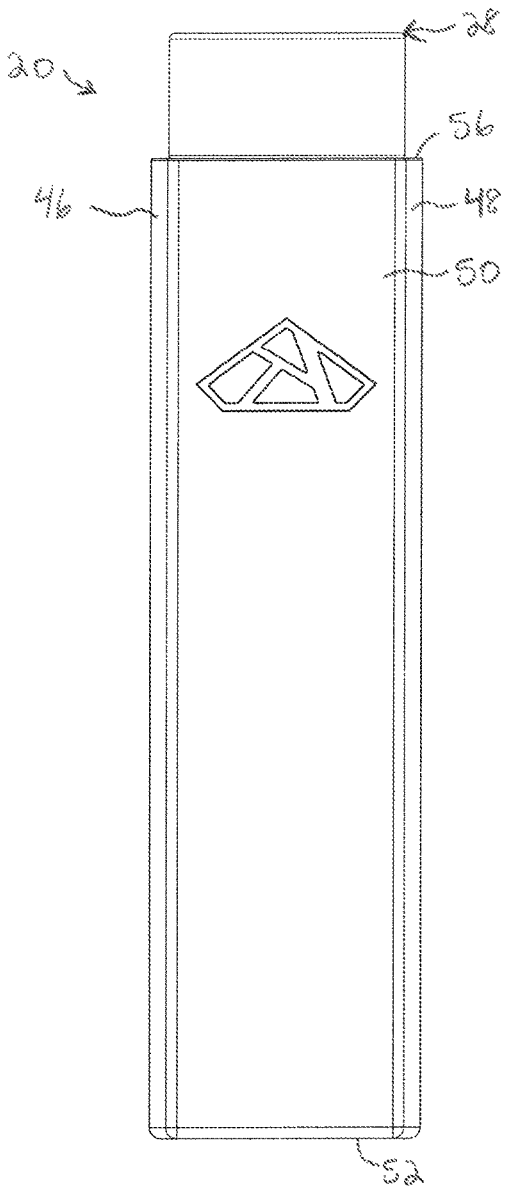
FIG. 4 a back view of the container assembly of FIG. 1.
Figure 5:
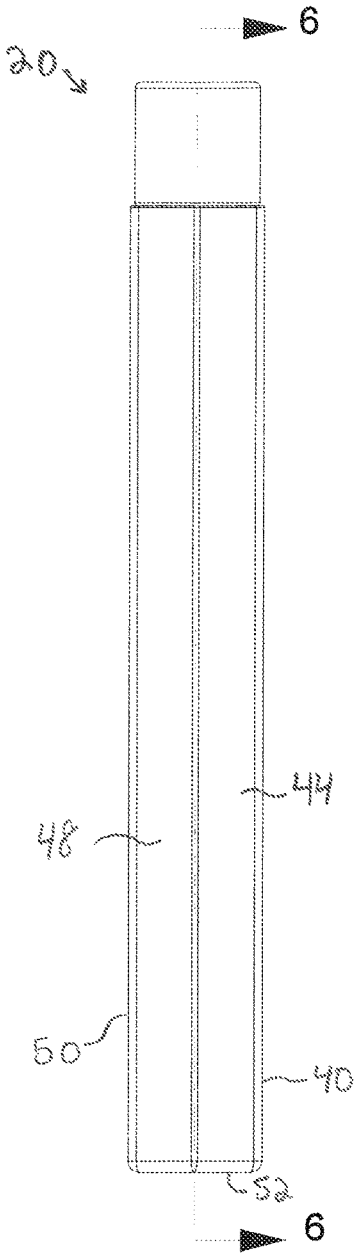
FIG. 5 is a right side view of the container assembly of FIG. 1.

The insertable wall 76 may have a length that is configured to allow a back end 118 of the insert 24 to be flush with a back outer surface of the outer wall 50 (as shown in FIGS. 3 and 4). For example, and briefly referring to FIGS. 3-5, after the container assembly 22 is assembled (i.e., the insert 24 is inserted into the channel 26) the back end 118 of the insert 24 may be flush with the back outer surface of the outer wall 50.

Referring again to FIG. 7 in particular, the insert 24 may include a faceplate 90 that may extend radially outward—relative to the longitudinal axis B—of the insertable wall 76. Extending radially outward allows the faceplate 90 to engage an axially facing ledge 92 extending radially outward—relative to the longitudinal axis B—of the channel 26 when the insertable wall 76 is fully-inserted in the channel 26. The shoulder 92 may prevent the faceplate 90 from moving through the channel 26, thereby preventing the insert 24 from moving entirely through the channel 26 in a first direction along the longitudinal axis B.

Extending radially outward also may allow the faceplate 90 to engage a radially inward facing faceplate wall 94 extending axially offset from the channel 26 and radially outward—relative to the longitudinal axis B—of the channel 26 when the insertable wall 76 is fully-inserted in the channel 26. The radially inward facing faceplate wall 94 may be formed in the outer wall 40 and/or the inner wall 74. The radially inward facing faceplate wall 94 and the faceplate 90 may press-fit together to prevent movement of the insert 24 relative to the container 22, after the insert 24 is fully-inserted. For example, the shape and size of a cross-section—transverse to the longitudinal axis B—of the radially inward facing faceplate wall 94 may match the faceplate 90. In an embodiment, the radially inward facing faceplate wall is slightly smaller than the faceplate. In another embodiment, the radially inward facing faceplate wall includes a lip or other protrusion to lock the faceplate to the container.

The faceplate 90 may be fluidly separated from the fluid reservoir 58 (shown in FIG. 6), when the insert 24 is assembled in the container 22. For example, the insertable wall 76 may abut the inner wall 74 to fluidly separate the faceplate 90 from the reservoir 58. Also, the inner wall 74 alone may fluidly separate the reservoir from the channel 26, thereby fluidly separating the faceplate 90 from the reservoir 58. In an embodiment, the insertable wall may engage the outer walls of the container to fluidly separate the reservoir of the container from the faceplate or interior portions of the insert.

Figure 8:
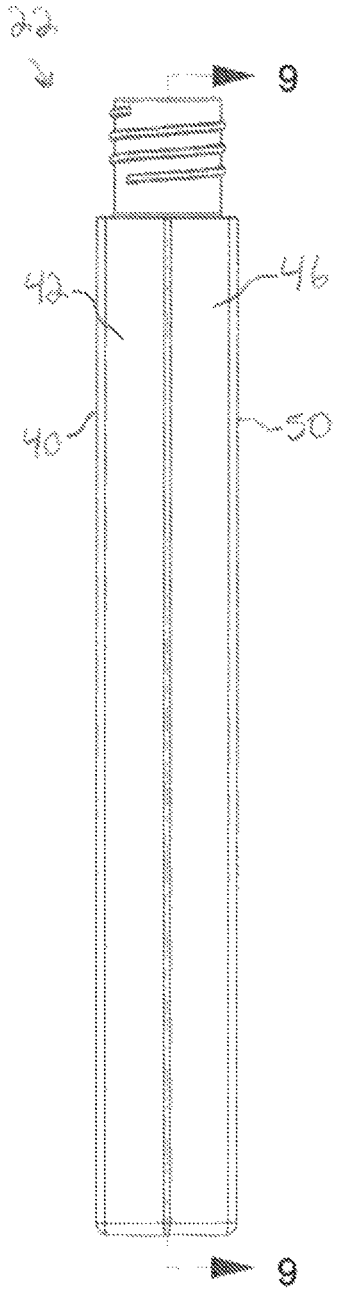
FIG. 8 is a side view of an exemplary container of the container assembly of FIG. 7.
Figure 9:
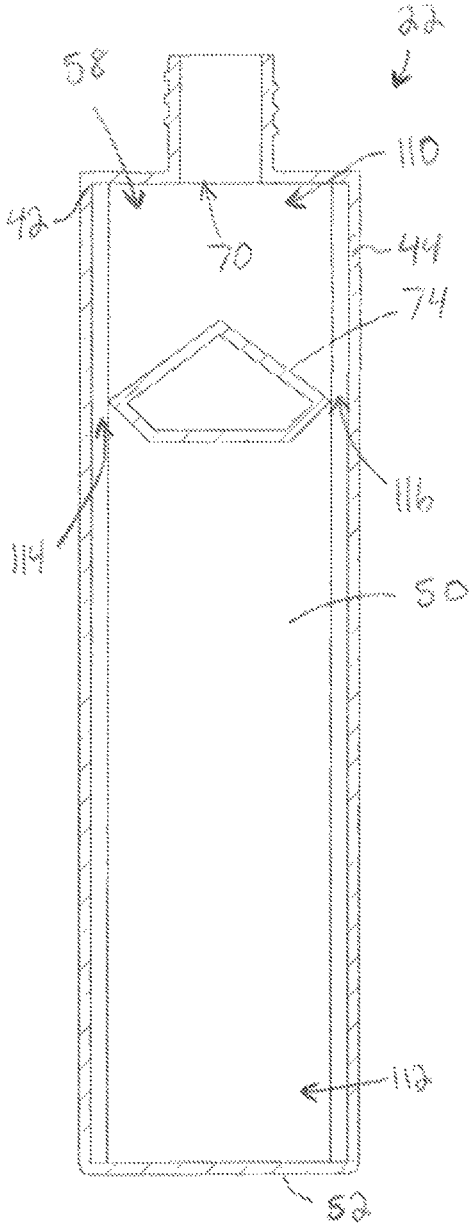
FIG. 9 is a cross-section view of the container of FIG. 8.
Figure 10:
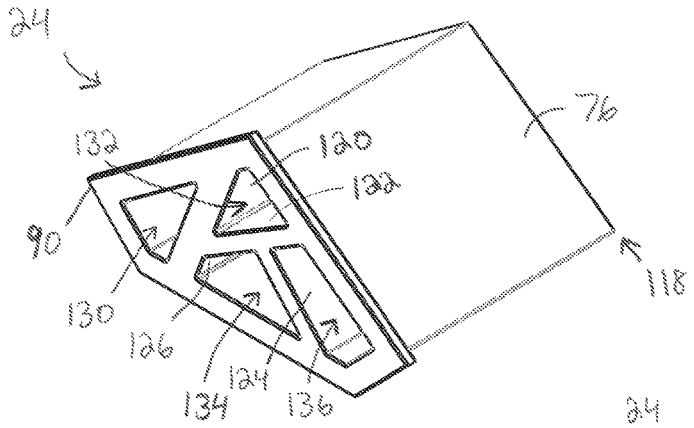
FIG. 10 is a perspective view of an insert of the container assembly of FIG. 1.
Figure 11:
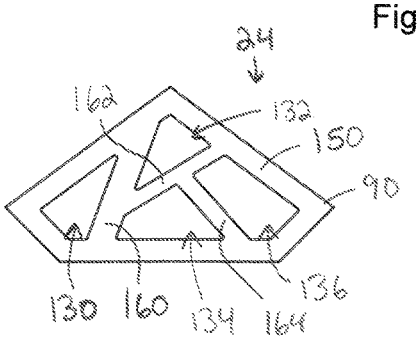
FIG. 11 is a front view of the insert of FIG. 10.
Figure 12:
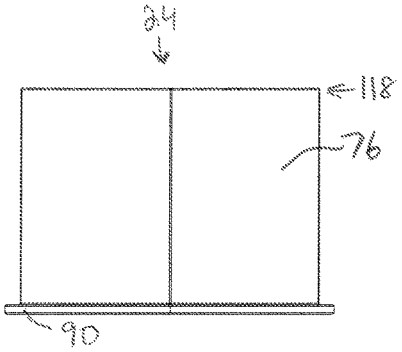
FIG. 12 is a top view of the insert of FIG. 10.
Figure 13:
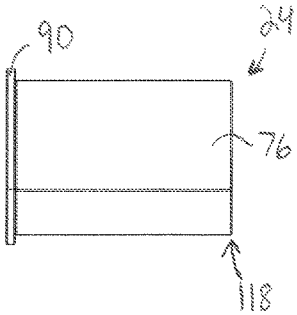
FIG. 13 is a side view of the insert of FIG. 10.
Figure 14:
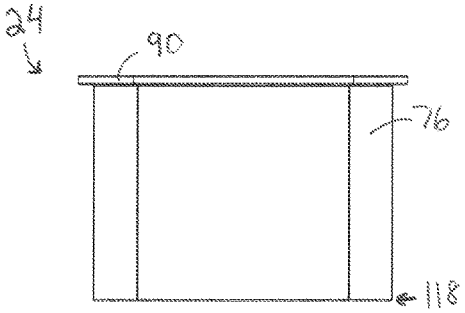
FIG. 14 is a bottom view of the insert of FIG. 10.

Referring now to FIGS. 8 and 9, the container 22 alone is illustrated with the outer walls 40, 42, 44, 46, 50, the inner wall 74, and the reservoir 58. The reservoir may include a top reservoir portion 110 and a lower reservoir portion 112 that are fluidly connected to each other. The top reservoir portion 110 may be adjacent the opening and the lower reservoir portion 112 may be adjacent the base 52.

Fluid paths 114, 116 may extend between the top reservoir portion 110 and the lower reservoir portion 112. The fluid path 114 may be formed by a space between the inner wall 74 and the outer walls 42, 46. The fluid path 116 may be formed by a space between the inner wall 74 and the outer walls 44, 48 (the outer wall 48 is shown in FIGS. 3 and 6). Thus, fluid may flow from the opening 70 to the lower reservoir portion 112 by flowing from the top reservoir portion 110 to either or both fluid paths 112, 114. Fluid may also flow from the lower reservoir portion 112 to the opening 70 by flowing through either or both fluid paths 114, 116 to the top reservoir portion 110. In an embodiment, the container includes only one fluid path. For example, the inner wall may not be spaced from one set of adjacent side outer walls.

The container 22 may be made of any suitable material, for example glass or another ceramic material. In an embodiment, the container is made of metal.

Referring now to FIGS. 10-14, the insert 24 alone is illustrated. As discussed above, the insert 24 may include the insertable wall 76 and the faceplate 90. The insert 24 may include logo walls 120-126.

The logo walls 120-126 may extend inward from the insertable wall 76 and may extend along a length of the insertable wall 76 to form a visible logo at the back end 118 of the insert 24. The logo walls 120-126 may define through passages 130-136 in the insert 24. In an embodiment, the logo walls are not included and a single through passage may be included in the insert. In another embodiment, the insert does not include a through passage. For example, the insert may have a solid interior or a wall extending along the entire back end of the insert.

The logo walls 120-126 may be any suitable shape or design. For example, the logo walls 120-126 may form have a K-shape cross-section. In another embodiment, the logo walls form a different shape.

The faceplate 90 may include a perimeter wall 150 that defines the outermost shape of the faceplate 90. The perimeter wall 150 may be configured to engage the axially facing ledge 92 and the radially inward facing faceplate wall 94. For example, the perimeter wall 150 may have a pentagonal cross-section, similar to the axially facing ledge 92 and the radially inward facing faceplate wall 94. In an embodiment, the perimeter wall has a different shape. In another embodiment, the perimeter wall is not present. For example, faceplate logo walls may be configured to engage the axially facing ledge and the radially inward facing faceplate wall when the insert is fully-inserted into the container.

The faceplate 90 may include faceplate logo walls 160-164 that form a similar shape as the logo walls 120-126. For example, the faceplate logo walls 160-164 may have a K-shape cross-section and may extend to the perimeter wall 150. In an embodiment, the faceplate logo walls form any other suitable shape or logo.

The entire insert 24 may be made of any material, such as aluminum or another metal. In an embodiment, the insert is made of another material, such as a ceramic. In another embodiment, the insert is at least partially made of another material, such as a ceramic.

Figure 15:
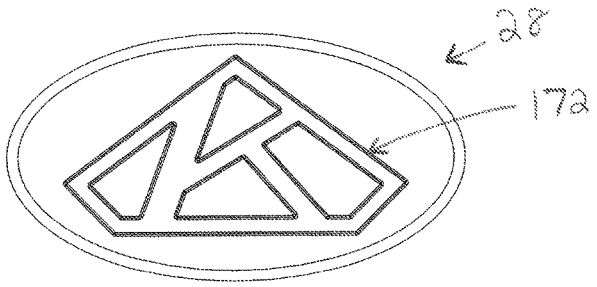
FIG. 15 is a top view of a cap of the container assembly of FIG. 1.
Figure 16:
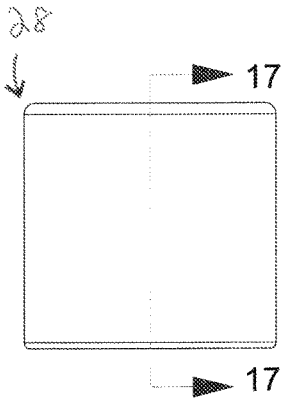
FIG. 16 is a side view of the cap of FIG. 15.
Figure 17:
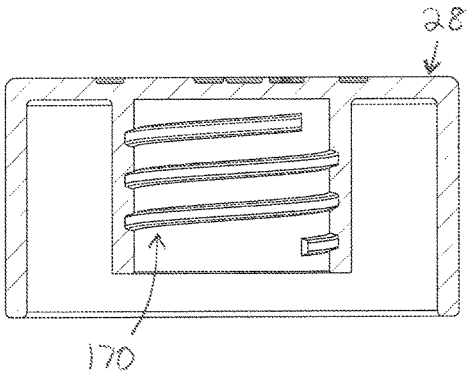
FIG. 17 is a cross-section view of the cap of FIG. 15.

Referring now to FIGS. 15-17, the cap 28 alone is illustrated. The cap 28 may include radially inward threads 170 for engage radially outward threads of the container 22 to secure the cap 28 to the container 22. The cap 28 may seal the container 22 when the cap 28 is secured to the container 22. For example, the cap 28 may prevent fluid from flowing out the opening 70 when the radially inward threads 170 are fully-engaged with the radially outward threads of neck 72 (shown in FIG. 7).

The cap 28 may include a logo 172. For example, the logo 172 may match the faceplate 90 and form a K-shape. In an embodiment, the cap includes any other suitable shape or logo.

The cap 28 may be made of any suitable material, such as aluminum or any other metal.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A container comprising:

a base;

a front outer wall, a rear outer wall, and at least two side walls extending upwards from the base;

an opening opposite the base;

wherein the base, the front outer wall, rear outer wall, and at least two side walls define a fluid reservoir;

the fluid reservoir and the container having a central axis extending upwardly from a midpoint of the base;

the container further comprising a channel having a polygonal cross section, the channel extending longitudinally from the front outer wall to the rear outer wall, and having a channel front opening in the front outer wall;

the channel having a bottom surface wall, and at least two opposite inner surface walls which slope toward the central axis of the container and meet at an apex along the central axis;

the channel front opening further comprising a recessed front lip around the perimeter of the front opening;

wherein the channel is spaced within the fluid reservoir below the opening so as to define an upper fluid reservoir adjacent the opening, a lower fluid reservoir adjacent the base, and first and second fluid paths within the fluid reservoir on either lateral side of the channel which fluidly connect the upper fluid reservoir to the lower fluid reservoir;

and further comprising a separate insert that is insertable into the channel.

2. The container of claim 1, further comprising an axial facing ledge at the channel front opening to prevent axial movement of the insert in a first axial direction relative to the container.

3. The container of claim 1 wherein the recessed front lip is a radially inward facing faceplate wall at an end of the channel to prevent axial movement of the insert relative to the container.

4. The container of claim 1, wherein the recessed front lip is a radially inward facing faceplate wall configured to press-fit against a radially outwardly facing surface of the insert.

5. The container of claim 1, wherein the channel is a through passage configured to receive an insertable wall of the insert.

6. The container of claim 1, wherein the channel inner surface walls are configured to circumscribe an insertable wall of the insert.

7. The container of claim 1, further comprising a cap to close the opening.

8. The container of claim 1, wherein the channel is fluidly separated from the fluid reservoir.

9. A container assembly comprising:

a container comprising:

a base;

a front outer wall, a rear outer wall, and at least two side walls extending upwards from the base;

and an opening opposite the base;

wherein the base, the front outer wall, rear outer wall, and at least two side walls define a fluid reservoir;

the fluid reservoir and the container having a central axis extending upwardly from a midpoint of the base;

the container further comprising a channel having a polygonal cross section, the channel extending longitudinally from the front outer wall to the rear outer wall and having a channel front opening in the front outer wall;

the channel having a bottom surface wall, and at least two opposite inner surface walls which slope toward the central axis of the container and meet at an apex along the central axis;

the container assembly further comprising an insert configured to be removably inserted into the channel, wherein the insert matches the polygonal cross-sectional profile of the channel.

10. The container assembly of claim 9, wherein the insert includes a plurality of planar radially outwardly facing surfaces for engaging the channel surface walls.

11. The container assembly of claim 9, wherein the insert is fluidly separated from the fluid reservoir.

12. The container assembly of claim 9, wherein channel surface walls define the channel and fluidly separate the channel from the fluid reservoir.

13. The container assembly of claim 12, wherein the insert comprises an insertable wall that engages the channel surface walls.

14. The container assembly of claim 9, wherein the insert comprises a faceplate that engages an axially facing ledge in the container front outer wall to prevent axial movement of the faceplate in a first direction relative to the axially facing ledge.

15. The container assembly of claim 9, wherein the insert comprises a faceplate that engages a radially inward facing faceplate wall to prevent axial movement of the faceplate relative to the radially inward facing faceplate wall.

16. The container assembly of claim 9, wherein the insert has a cross section in the shape of a logo.

17. The container assembly of claim 9, wherein the insert is at least partially made of aluminum.

18. The container assembly of claim 9, wherein the container is at least partially made of glass.

19. The container assembly of claim 9, further comprising a cap to close the opening.

* * * * *